US006789403B2

(12) United States Patent
Okamoto

(10) Patent No.: US 6,789,403 B2
(45) Date of Patent: Sep. 14, 2004

(54) METHOD FOR KNITTING A CABLE PATTERN INTO A TUBULAR KNITTED FABRIC

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/470,729

(22) PCT Filed: Jan. 24, 2002

(86) PCT No.: PCT/JP02/00529

§ 371 (c)(1),
(2), (4) Date: Jul. 31, 2003

(87) PCT Pub. No.: WO02/063084

PCT Pub. Date: Aug. 15, 2002

(65) Prior Publication Data

US 2004/0060329 A1 Apr. 1, 2004

(30) Foreign Application Priority Data

Feb. 2, 2001 (JP) ..... 2001-027172

(51) Int. Cl.[7] ..... D04B 7/04
(52) U.S. Cl. ..... 66/64; 66/176
(58) Field of Search ..... 66/64–75.1, 172 R–176, 66/197–200

(56) References Cited

U.S. PATENT DOCUMENTS

| | | | | | |
|---|---|---|---|---|---|
| 2,264,016 | A | * | 11/1941 | Bialostok | 66/200 |
| 2,910,852 | A | * | 11/1959 | Herbert et al. | 66/180 |
| 3,581,526 | A | * | 6/1971 | Haehnel | 66/96 R |
| 4,197,724 | A | * | 4/1980 | Robinson et al. | 66/176 |
| 5,263,342 | A | * | 11/1993 | Mundstock | 66/198 |
| 5,887,451 | A | * | 3/1999 | Suzuki | 66/64 |

FOREIGN PATENT DOCUMENTS

| | | |
|---|---|---|
| JP | 5-287652 | 11/1993 |
| JP | 8-113853 | 5/1996 |
| WO | 01/57299 | 8/2001 |

* cited by examiner

*Primary Examiner*—Danny Worrell
(74) *Attorney, Agent, or Firm*—Wenderoth, Lind & Ponack, L.L.P.

(57) ABSTRACT

A method for knitting a cable pattern into a tubular knitted fabric with high productivity is disclosed. Two groups of knitting stitches to be crossed are arranged in alignment on one needle bed and crossed when they are transferred to another needle bed, and these crossed groups of knitting stitches are securely hooked onto front and back needle beds so as to form a cable pattern in a portion extending over both needle beds.

2 Claims, 4 Drawing Sheets

METHOD FOR KNITTING A CABLE PATTERN INTO A TUBULAR KNITTED FABRIC

This application is a National Stage of International Application No. PCT/JP02/00529, filed Jan. 24, 2002.

TECHNICAL FIELD

The present invention relates to a method for forming a cable pattern in a tubular knitted fabric produced by front and back needle beds.

BACKGROUND ART

A standard flat knitting machine (2-bed) having front and back needle beds, or a flat knitting machine (4-bed) having another pair of needle beds in addition to the front and back needle beds of the flat knitting machine mentioned above, is known for knitting, for example, a tubular knitted fabric. Numerous needles are implanted in rows in the needle beds of the flat knitting machines. Knitting yarn is fed through a yarn feeding inlet from needles of the front needle bed to needles of the back needle bed, or vice versa, so as to go around these needles, thus allowing a tubular knitted fabric to be produced.

A typical knitting method for forming a cable pattern in such a tubular knitted fabric, which is an object of the present invention, will be explained.

The cable pattern is formed by crossing adjacent knitting stitches to switch them, so that this cable pattern is called a cross pattern or a cable pattern. Such a pattern is called a cable pattern of 1×1, 2×2, 3×3 . . . , depending on the number of crossed knitting stitches.

In addition to cable patterns having the same number of mutually crossed knitting stitches as mentioned above, cable patterns of combinations of different numbers of crossed knitting stitches as 1×2, 1×3, 2×3 . . . can also be obtained. Furthermore, two or more different combinations are possible; namely, whether a right or left knitting stitch, or a group of knitting stitches, is set on an upper side of crossing when crossing the right or left knitting stitch, or the group of knitting stitches.

For example, a method for knitting a 3×3 cable pattern by using a 2-bed flat knitting machine previously proposed in Japanese Unexamined Patent Application Publication No. 8-113853 is known. ×FIG. 3 through FIG. 6 in the publication show an example in which a 3×3 cable pattern is formed at a right edge of a sweater by using the 2-bed flat knitting machine.

A left group of knitting stitches ①②③ that cross knitting needles H, I and J of a front needle bed is locked, while a group of knitting stitches ④⑤⑥ on a right side of this crossing is hooked on knitting needles j, i and h of a back needle bed. The group of knitting stitches on the right side is located on an upper side by crossing, thereby forming the 3×3 cable pattern. This crossing is accomplished primarily according to the following procedure.

After completing separate knitting in FIG. 4–2, knitting stitch ③ is transferred to knitting needle G of the back needle bed in FIG. 4–3, and knitting stitch ② is transferred to knitting needle H of the back needle bed in FIG. 4—4. Subsequently, knitting stitch ④ is transferred to knitting needle h of the front needle bed in FIG. 4–5, knitting stitch ⑤ is transferred to knitting needle i of the front needle bed in FIG. 5–1, and knitting stitch ⑥ is transferred to knitting needle j of the front needle bed in FIG. 5–2.

Knitting stitch ① is transferred to knitting needle I of the back needle bed in FIG. 5–3, then knitting stitches ④⑤⑥ are transferred to knitting needles hij of the back needle bed in FIG. 5–4 so as to arrange the knitting stitches in the order of ③②④①⑤⑥ from the left. At this time, idle needles g and j exist between knitting stitches ③ and ② and between knitting stitches ⑤ and ⑥.

Subsequently, in FIG. 5—5, the group of knitting stitches ④⑤⑥ is transferred to knitting needles H, I and J of the front needle bed. In FIG. 6–1, the group of knitting stitches ①②③ is transferred to the front needle bed so that these stitches are respectively positioned among knitting stitches ④⑤⑥. Thereafter, the group of knitting stitches ①②③ is transferred to. the back needle bed in FIG. 6–2 to complete the crossing.

In the cable pattern formed according to the procedure described above, the knitting stitches transferred to the front and back needle beds are twisted. FIG. 8 illustrates a method in which a yarn feeding direction for the knitting stitches to be transferred is reversed to form pre-twisted knitting stitches, then the pre-twisted stitches are untwisted during a following stitch transfer step.

The method described in the above publication has been posing a problem in that each knitting stitch of a crossing group of knitting stitches is moved by jumping over another group of knitting stitches, thus requiring much labor with consequent low productivity.

Moreover, the tubular knitted fabric includes ribbed knit or the like. Hence, for a so-called "skipped needle" mode, in which every other knitting needle of a needle bed is used, crossing causes a moving distance of knitting stitches that jump over another group of knitting stitches to become long. This has been presenting a problem in that yarn easily breaks, thereby preventing a knitting speed from being increased.

Furthermore, as a number of crossing knitting stitches increases, it becomes difficult to secure idle needles for depositing knitting stitches.

The present invention has been proposed in view of the problems described above, and it is an object of the invention to make it possible to provide a method for knitting a cable pattern into a tubular knitted fabric with high productivity.

SUMMARY OF THE INVENTION

To fulfill the above object, a method for knitting a cable pattern into a tubular knitted fabric in accordance with the present invention is a method for knitting a cable pattern into a tubular knitted fabric so as to form a cable pattern in a fabric knitted into a tubular shape by using a flat knitting machine equipped with at least front and back needle beds, wherein one group of knitting stitches, from among groups of knitting stitches to be crossed in a knitted fabric portion extending over knitting needles of both needle beds, is transferred to another group of knitting stitches, beginning with a knitting stitch at an edge thereof so as to arrange these two groups of knitting stitches at an edge of a knitting portion of the tubular knitted fabric on either the front or the back needle bed. Both groups of arranged knitting stitches are transferred to the other needle bed, and cross one another when they are transferred from the other needle bed back to the one needle bed, and the group of knitting stitches on an inner edge of these two crossed groups of knitting stitches is moved back to the other needle bed, beginning with knitting stitches on an edge thereof so as to knit the cable pattern on a side edge of the tubular knitted fabric.

Next, a tubular knitted fabric is produced in a state wherein the groups of knitting stitches to be crossed have been arranged at an end portion of either the front or back needle bed. Both groups of the arranged knitting stitches are transferred to the other needle bed and crossed when they are transferred from the other needle bed back to the one needle bed, and the group of knitting stitches on an inner edge of these two crossed groups of knitting stitches is moved back to the other needle bed, beginning with a knitting stitch on an edge thereof so as to further knit the tubular knit fabric.

DETAILED DESCRIPTION OF THE PREFERRED EMBODIMENTS

The following will describe an embodiment related to a method for knitting a cable pattern into a tubular knitted fabric according to the present invention in conjunction with the accompanying drawings.

Figure 1:
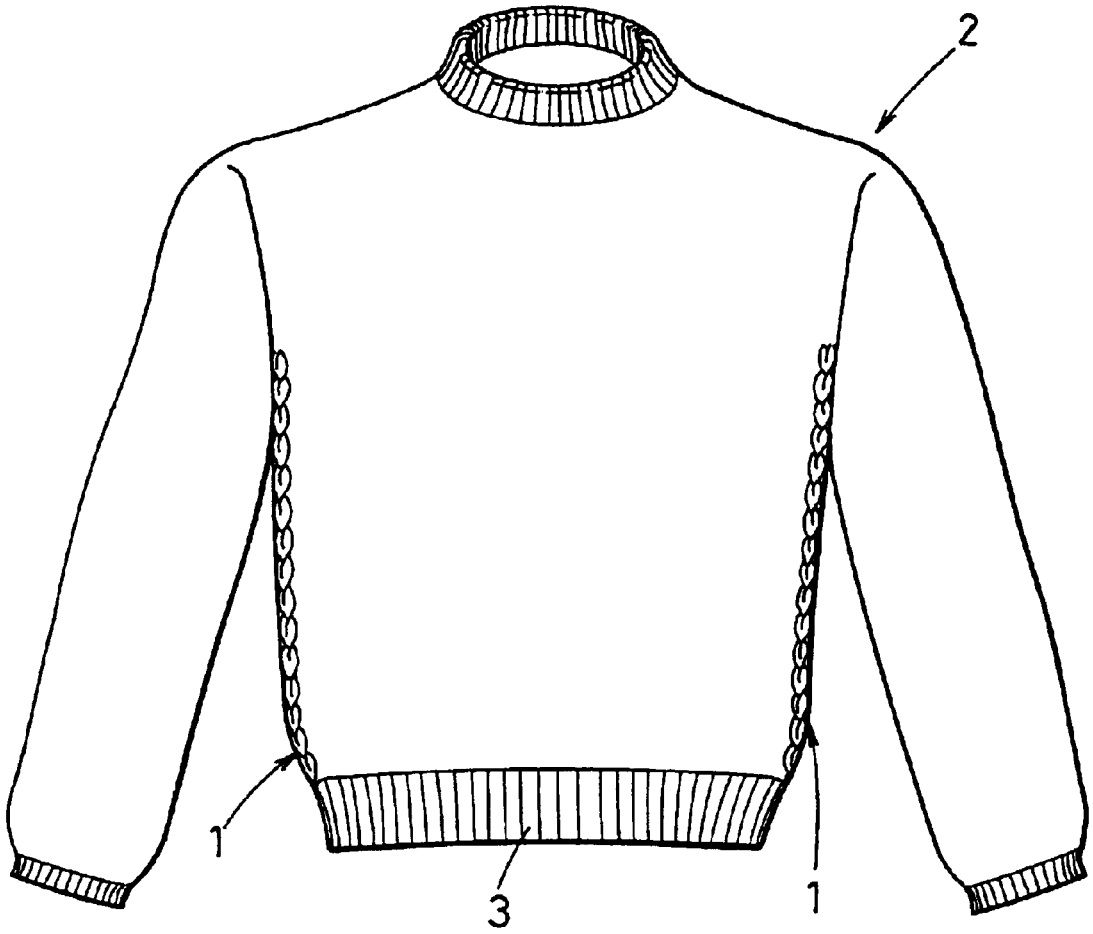
FIG. 1 is a front view of a sweater of a tubular knitted fabric in which cable patterns have been formed on sideline portions.
Figure 2:
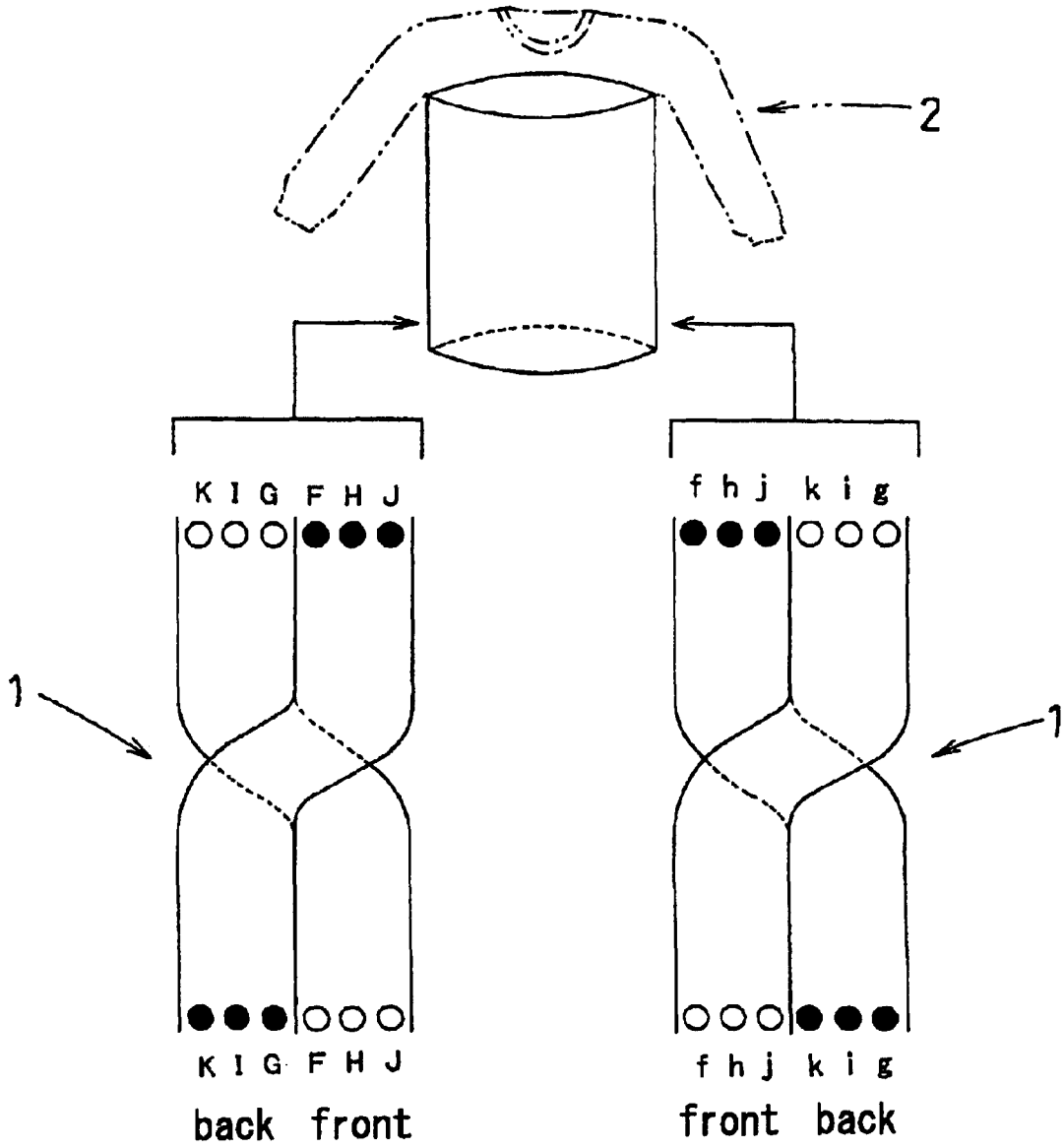
FIG. 2 is an enlarged front view schematically showing cable pattern portions.

FIG. 1 shows a schematic front view of a seamless sweater (tubular knitted fabric) with cable patterns formed on right and left sideline portions. FIG. 2 is a partial enlarged view showing configurations of the cable patterns formed on the sideline portions (side edge portions), wherein reference numeral 1 in the drawing denotes a 3×3 cable pattern formed in a seamless sweater 2. The 3×3 cable pattern 1 is formed of three knitting stitches (a group of knitting stitches) that are crossed with three knitting stitches of another group. A knitting procedure thereof will be explained in conjunction with FIG. 3 and FIG. 4.

A flat knitting machine used in this example to implement the method for knitting the cable patterns in the sideline portions of the seamless sweater 2 is a 2-bed flat knitting machine operated in a so-called "skipped needles" mode in which every other knitting needle of a needle bed is used.

Figure 3:
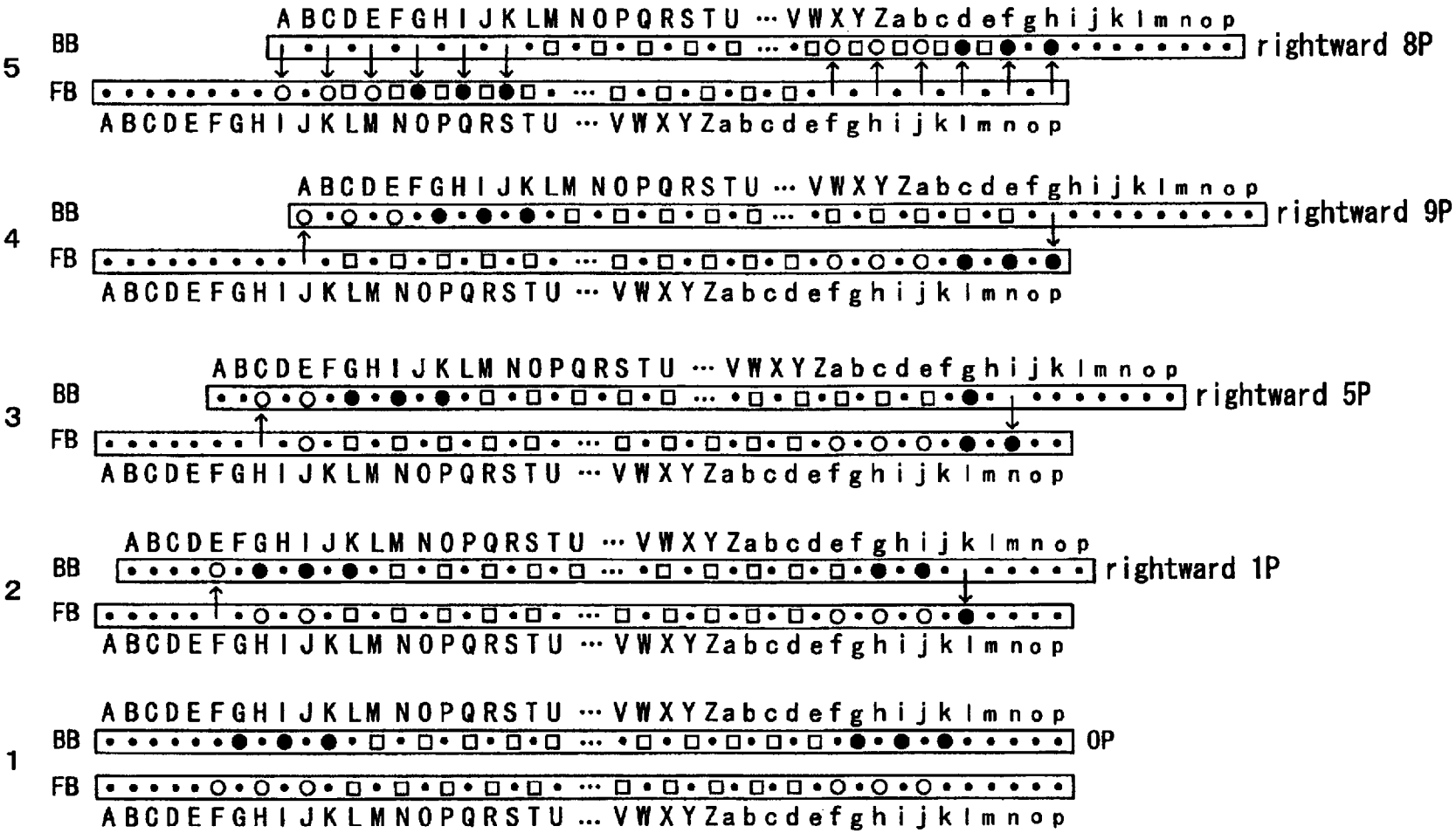
FIG. 3 is a course diagram for forming the cable patterns.
Figure 4:
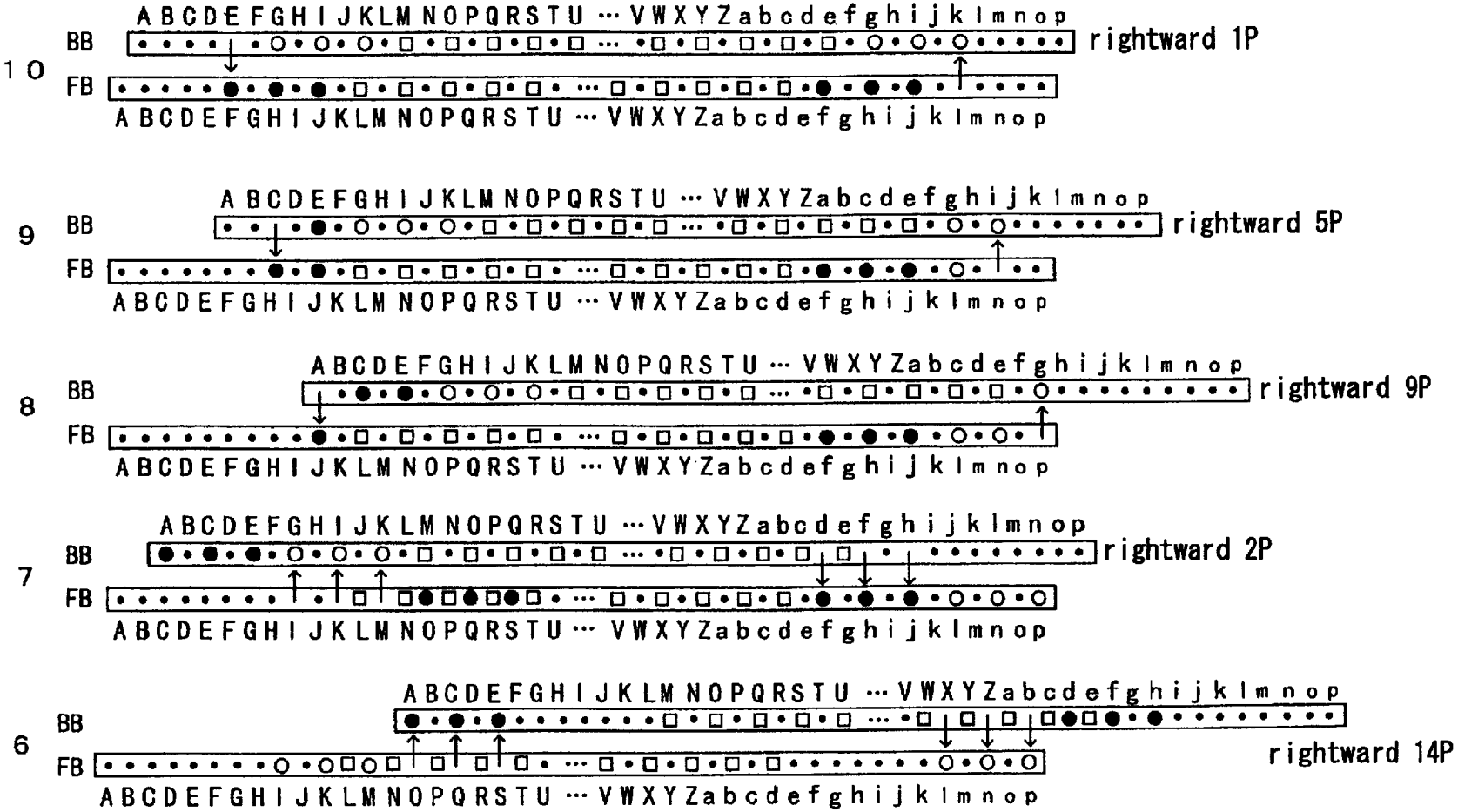
FIG. 4 is a course diagram for forming the cable patterns.

In FIG. 3 and FIG. 4, the numbers on the left side indicate the numbers of courses for forming the cable pattern, letters FB denote a front needle bed, letters BB denote a back needle bed, and the letters shown on the upper or lower side of each needle bed denote knitting needles.

Furthermore, the alphanumeric symbols on the right side denote an amount and direction of racking (moving) (the number of pitches) of the back needle bed when a state in which formation of the cable pattern (course 1 in FIG. 3) is begun, with the front and back needle beds being ready defined as reference position (0P).

Symbol ○ of each needle bed denotes a knitting stitch hooked on a knitting needle of the front needle bed operated to form the cable pattern. Similarly, symbol ● denotes a knitting stitch hooked on a knitting needle of the back needle bed. Symbol □ denotes a knitting stitch of the front and back needle beds other than the knitting stitches denoted by ○ and ●.

An elastic portion 3 of a bottom of the sweater 2 shown in FIG. 1 is knitted, and during course 2 in which the back needle bed is racked 1 pitch rightward from a state wherein formation of the cable pattern indicated by course 1 in FIG. 3 is started, a knitting stitch on knitting needle k at a right end of the back needle bed is transferred onto knitting needle 1 of the front needle bed, and a knitting stitch on knitting needle F at a left end of the front needle bed is transferred onto knitting needle E of the back needle bed.

Thus, a tubular knitted fabric during the knitting process on the front and back needle beds has turned one lap clockwise.

The term "turn" in the present invention does not mean that the knitted fabric in its entirety moves; rather it refers to an event in which knitting stitches on one end of the front needle bed increase, while knitting stitches on the other end decrease, thereby making the knitted fabric look as if it had turned.

Next, during course 3, the back needle bed is racked 5 pitches rightward to transfer a knitting stitch on knitting needle i at the right end of the back needle bed onto knitting needle n of the front needle bed, and a knitting stitch on knitting needle H at the left end of the front needle bed is transferred onto knitting needle C of the back needle bed. Thus, the tubular knitted fabric during the knitting process on the front and back needle beds has turned clockwise another lap.

During course 4, the back needle bed is racked 9 pitches rightward to transfer a knitting stitch on knitting needle g at the right end of the back needle bed onto knitting needle p of the front needle bed, and a knitting stitch on knitting needle J at the left end of the front needle bed is transferred onto knitting needle A of the back needle bed. Thus, the tubular knitted fabric during the knitting process on the front and back needle beds has undergone still another clockwise turn.

As a result, knitting stitches that were on knitting needles g, i and k at the right end of the back needle bed during course 1 have been sequentially fed to the front needle bed, so that knitting stitches forming a cable pattern on the right side of the sweater 2 are arranged adjacently in alignment on knitting needles f, h, j and l, n, p of the front needle bed.

The knitting stitches that were on knitting needles F, H and J at the left end of the front needle bed have been sequentially fed to the back needle bed. As a result, knitting stitches forming a cable pattern on the left side of the sweater 2 are arranged adjacently in alignment on knitting needles A, C, E and G, I, K of the back needle bed.

During course 5, the back needle bed is racked 8 pitches rightward from the reference position, and during course 4 and thereafter, the back needle bed is racked 1 pitch leftward. The knitting stitches on knitting needles f, h, j and l, n, p arranged in alignment on the front needle bed are temporarily transferred onto knitting needles X, Z, b and d, f, h, of the back needle bed, that oppose above needles f, h, j and l, n, p. Similarly, the knitting stitches on knitting needles A, C, E and G, I, K of the back needle bed are temporarily transferred onto knitting needles I, K, M and O, Q, S of the front needle bed, that oppose above needles A, C, E and G, I, K.

Thereafter, during course 6, the back needle bed is racked 14 pitches rightward, and the knitting stitches on knitting needles X, Z, b of the back needle bed are put back onto knitting needles l, n, p of the front needle bed, and the knitting stitches on knitting needles O, Q, S of the front needle bed are put back onto knitting needles A, C, E of the back needle bed.

During course 7, the back needle bed is racked 2 pitches rightward, and the knitting stitches on knitting needles knitting needles d, f, h of the back needle bed are put back onto knitting needles f, h, j of the front needle bed, and the knitting stitches on knitting needles I, K, M of the front needle bed are put back onto knitting needles C, G, I, K of the back needle bed. This causes a crossed cable pattern to emerge on one end portion of each of the front and back needle beds.

During course 8, the back needle bed is racked 9 pitches rightward to transfer the knitting stitch on knitting needle p at an end of the front needle bed onto knitting needle g of the back needle bed, and the knitting stitch on knitting needle A of the back needle bed is transferred onto knitting needle J of the front needle bed. Thus, the tubular knitted fabric that has turned three laps clockwise from course 1 to course 4 is turned one lap counterclockwise.

During course 9 and course 10, the knitting stitches on knitting needles n, l of the front needle bed are sequentially transferred onto knitting needles i, k of the back needle bed, and the knitting stitches on knitting needles C, E of the back needle bed are sequentially transferred onto knitting needles H, F of the front needle bed while moving the back needle bed, as during course 8 described above. Thus, the tubular knitted fabric is further turned counterclockwise and set back to a status of course 1, thus completing formation of the cable pattern.

As explained in the above embodiment, to form the 3×3 cable pattern, unlike the previously proposed art in which groups of knitting stitches are crossed stitch by stitch, crossing can be accomplished by two courses, namely, course 6 and course 7 shown in FIG. 4. Hence, knitting stitches can be easily transferred, thereby permitting improved knitting efficiency. The present invention, however, is not limited to the formation of the 3×3 cable pattern set forth above. More specifically, the present invention is advantageously applied also to a case that involves a number of crossing knitting stitches of 3×3 or more, because idle needles can be secured for transferring stitches.

Furthermore, in the cable pattern formed in the foregoing embodiment, knitting stitches of crossed portions are twisted; however, this twisting may be prevented by applying the knitting method for untwisting stitches disclosed in Japanese Unexamined Patent Application Publication No. 8-113853 described above, or separate knitting for preventing breakage of yarn at a time of stitch transfer may be performed, as necessary.

In short, according to the present invention, two groups of knitting stitches to be crossed so as to form a cable pattern in a tubular knitted fabric are arranged in alignment on one needle bed, the knitting stitches are crossed when they are transferred onto the other needle bed or when transferred groups of knitting stitches are moved back to the one needle bed, and then these crossed groups of knitting stitches are hooked onto the front and back needle beds, thereby forming the cable pattern in the portion extending over the two needle beds.

Hence, it is needless to say that the flat knitting machine for implementing the present invention is not limited to the aforesaid two-bed type, but may be the so-called "4-bed" type having another pair of needle beds in addition to the two beds.

Furthermore, in the above embodiment, groups of knitting stitches are arranged on one needle bed to form the cable pattern. Alternatively, however, in the case of, for example, the sweater shown in FIG. 1, when forming the bottom elastic portion, groups of knitting stitches to be crossed may be arranged beforehand on an end portion of either the front or the back needle bed, i.e., set in a so-called "offset" state, then a body and sleeve tubular knit fabric may be knitted up to a side where they meet. After that, a lap may be made in a direction for clearing the "offset" to position the cable pattern at a sideline, and then the body and the sleeve may be joined.

In this case, as compared with the case of the embodiment shown above, the number of laps of turning the tubular knitted fabric for forming the cable pattern can be decreased. Alternatively, standard knitting may be performed until the bottom elastic portion is finished, and then after completion of knitting the bottom elastic portion, the tubular knitted fabric may be turned to form a cable pattern while maintaining groups of knitting stitches to be crossed in an arranged alignment state on one of the needle beds until the tubular knitted fabric is formed up to a side. At the side, the tubular knitted fabric is turned in a reverse direction so as to set the cable pattern at the sideline to join the body and the sleeve.

INDUSTRIAL APPLICABILITY

As explained above, according to the method for knitting a cable pattern into a tubular knitted fabric, groups of knitting stitches to be crossed are arranged on an end portion of a region of either a front or a back needle bed where the tubular knitted baric is formed. While maintaining this arranged condition, the groups of knitting stitches are transferred onto the other needle bed, then they are crossed when they are transferred from the other needle bed back onto the one needle bed, and these crossed knitting stitches are transferred from the other needle bed back onto the one needle bed so as to knit the cable pattern into the tubular knitted fabric. Thus, it is possible to transfer at one time a plurality of knitting stitches to be crossed or transferred.

This arrangement obviates trouble of moving a group of crossed knitting stitches one by one, and jumping over another group of knitting stitches, as described in the foregoing publication, thus providing an advantage in which dramatically improved productivity can be achieved.

What is claimed is:

1. A method for knitting a cable pattern into a tubular knitted fabric, comprising:

using a flat knitting machine, including a front needle bed having knitting needles and a back needle bed having knitting needles, to form a tubular knitted fabric extending over the knitting needles of said front needle bed and said back needle bed;

transferring a first group of knitting stitches from knitting needles of one of said front and back needle beds to knitting needles of the other of said front and back needle beds so as to be arranged adjacent a second group of knitting stitches on knitting needles of said other of said front and back needle beds at an edge of a portion of said tubular knitted fabric, wherein a knitting stitch at an edge of said first group is first transferred and then each remaining adjacent knitting stitch of said first group is successively transferred; then transferring said first group of knitting stitches and said second group of knitting stitches from the knitting needles of said other of said front and back needle beds to knitting needles of said one of said front and back needle beds; then transferring said first group of knitting stitches and said second group of knitting stitches from the needles of said one of said front and back needle beds to needles of said other of said front and back needle beds, such that said first and second groups of knitting stitches cross one another; and then from among said first and second groups of knitting stitches, transferring the innermost group to needles of said one of said front and back needle beds, wherein a knitting stitch at an edge of said innermost group is first transferred and then each remaining adjacent knitting stitch of said innermost group is successively transferred so as to knit a cable pattern on said edge of said portion of said tubular knitted fabric.

2. A method for knitting a cable pattern into a tubular knitted fabric, comprising:

using a flat knitting machine, including a front needle bed having knitting needles and a back needle bed having knitting needles, to form a tubular knitted fabric extending over the knitting needles of said front needle bed and said back needle bed, with first and second groups of knitting stitches to be crossed being arranged at and end portion of one of said front and back needle beds;

transferring said first group of knitting stitches and said second group of knitting stitches from the knitting needles of said front and back needle beds to knitting needles of the other of said front and back needle beds; then transferring said first group of knitting stitches and said second group of knitting stitches from the needles of said other of said other of said front and back needle beds to needles of said one of said front and back needles beds, such that said first and second groups of knitting stitches cross one another; and then from among said first and second groups of knitting stitches, transferring the innermost group to needles of said other of said front and back needle beds, wherein a knitting stitch at an edge of said innermost group is first transferred and then each remaining adjacent knitting stitch of said innermost group is successively transferred so as to further knit said tubular knitted fabric.

* * * * *